US005931477A

United States Patent [19]

Demarchi

[11] Patent Number: 5,931,477

[45] Date of Patent: Aug. 3, 1999

[54] ROLLER SKATE

[75] Inventor: Jean-Louis Demarchi, Saint-Jorioz, France

[73] Assignee: Salomon S.A., Metz-Tessy, France

[21] Appl. No.: 08/804,268

[22] Filed: Feb. 21, 1997

[30] Foreign Application Priority Data

Mar. 18, 1996 [FR] France ..... 96 03564

[51] Int. Cl.[6] ..... A63C 17/06

[52] U.S. Cl. ..... 280/11.22; 280/11.27; 301/5.7

[58] Field of Search ..... 280/11.22, 11.27, 280/11.28, 11.19, 11.23; 301/5.3, 5.7

[56] References Cited

U.S. PATENT DOCUMENTS

| | | | |
|---|---|---|---|
| 938,168 | 10/1909 | Nolan . | |
| 4,603,868 | 8/1986 | Schutz | 280/11.22 X |
| 5,048,848 | 9/1991 | Olson et al. | 280/11.27 X |
| 5,068,956 | 12/1991 | Malewicz | 280/11.27 X |
| 5,271,633 | 12/1993 | Hill, Jr. | 280/11.22 |
| 5,366,232 | 11/1994 | Pozzobon et al. | 280/11.22 |
| 5,374,072 | 12/1994 | Landers | 280/11.22 X |
| 5,411,278 | 5/1995 | Wittmann | 280/11.22 |
| 5,505,470 | 4/1996 | Hoshizaki | 280/11.27 X |

FOREIGN PATENT DOCUMENTS

| | | | |
|---|---|---|---|
| 0684055 | 11/1995 | European Pat. Off. | A63C 17/06 |
| 2679781 | 2/1993 | France | A63C 17/18 |
| 95/13709 | 11/1995 | France . | |
| WO92/10251 | 6/1992 | WIPO | A63C 17/16 |

*Primary Examiner*—Robert J. Oberleitner
*Assistant Examiner*—Michael Mar
*Attorney, Agent, or Firm*—Greenblum & Bernstein P.L.C.

[57] ABSTRACT

In-line roller skate constituted by a frame on an upper plate of which a boot sole is fixed, and including a longitudinal lower portion on which the wheels are arranged, wherein at least one of the central wheels has an arrangement for adjusting the height with respect to the frames, which is constituted by off-centered zones interposed between the ends of a central hub of the wheel and a fixed portion of the frame, so as to modify the rolling plane of the wheels on the ground to the taste of the skater, depending on the type of skating involved.

12 Claims, 2 Drawing Sheets

ROLLER SKATE

BACKGROUND OF THE INVENTION

1. Field of the Invention

The present invention relates to a roller skate, especially an in-line roller skate, constituted by a frame including an upper plate on which the sole of a boot is adapted to be fixed and including a longitudinal lower portion on which the rollers or wheels are arranged.

2. Background and Material Information

This type of skate can be adapted to the training of skaters on ice outside of a skating rink, but also for any athletes eager to maintain or perfect on tarred, hard ground, cement floor, etc., the techniques used in gliding sports such as trail skiing, cross country skiing, ice skating, etc.

The practice of such sports has naturally evolved into the search for artistic or acrobatic ballet type maneuvers performed during skating. Thus, skates are known whose lower wheel line describes a convex arc of a circle which thus enables the skates to only bear on the central wheels. The drawback in such skates is that this arrangement is permanent and not always desired. That is the case of the skate described in the U.S. Pat. No. 938,168 which further includes means for adjusting its size to adapt it to a given boot.

The Applicant has already remedied this drawback in non-published French Patent Application No. 95.13709 which describes a device for controlling the height of the wheels, making it possible to act as required on the alignment of the wheels of the skate as a function of the desired skating effects.

In fact, one has sought to obtain a so-called "rocker" or "pivoting" position for the skate when the lower plane of the wheels forms an arc of a circle, and "anti-rocker" when the lower plane thereof is on a straight line, for a "non-pivoting" position.

In the aforementioned application, this has been obtained with the arrangement of a skate frame made in two portions connected to one another and journalled with respect to one another via a deformable zone. Means have also been provided so that this deformation is, or is not, permanent.

There is no particular criticism on such an embodiment providing the desired advantages.

It is also known to have a wheel height adjustment with respect to the frame by means of eccentric washers arranged on the journal axles of the wheels. However, such a simple and relatively inexpensive construction has the disadvantages of requiring additional parts and handling, and of generating risks of off-centering for the wheel axles if the washers of a same axle are not positioned in the common way.

SUMMARY OF THE INVENTION

An object of the present invention is to provide a simple and inexpensive construction which enables a wheel height adjustment without calling for additional parts, and which makes it possible to avoid the aforementioned disadvantages.

To this end, the invention relates to an in-line roller skate constituted by a frame including an upper plate, on which a boot is adapted to be fixed, and a lower portion on which the wheels are arranged, wherein at least one of the wheels has an arrangement for adjusting the height of such wheel with respect to the frames, which is constituted by at least one off-centered zone interposed between the hub of the wheel and a fixed portion of the frame, and carried by the hub itself so as to modify the rolling plane of the wheels on the ground to the preference of the skater, depending on the type of skating involved, by mere pivoting of the hub.

According to an advantageous characteristic of the invention, the arrangement for adjusting the height of the wheel is constituted by two end zones of the hub of this wheel, which are an integral part thereof, off-centered with respect to the axis of the hub, and which are capable of taking support, along a selected orientation, in the corresponding housings of the fixed portion of the frame.

Due to such an arrangement, it is interesting to note that in this case, the wheel height adjustment is done without addition nor handling of intermediate elements, simply by detaching the hub of the wheel and rotating the hub with off-centered ends over itself by 180°.

BRIEF DESCRIPTION OF DRAWINGS

The present invention is also related to the characteristics which will become apparent from the following description, and which must be considered separately or according to all of their possible technical combinations This description, which is provided by way of a non-limiting example, will help to better understand how the invention can be embodied, with reference to the annexed drawings, in which.

DETAILED DESCRIPTION OF THE PREFERRED EMBODIMENTS

Figure 1:
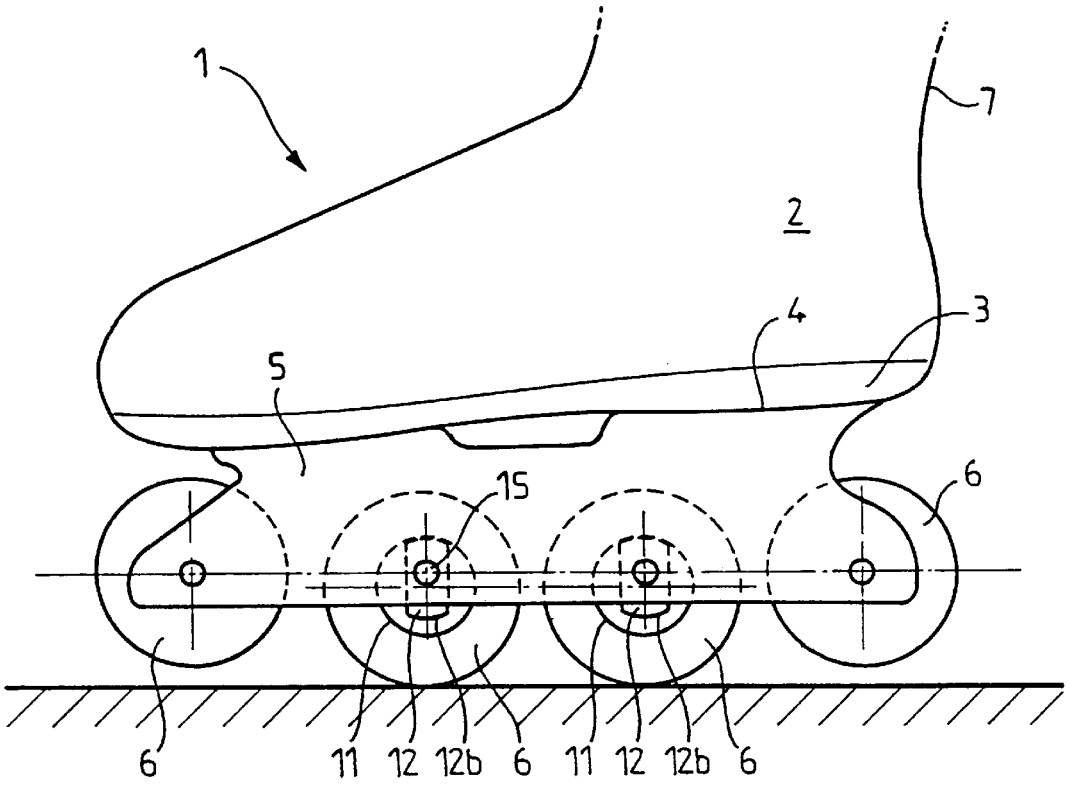
FIG. 1 is a lateral view of an in-line roller skate and of an associated boot in a rockering position.

The in-line roller skate generally designated by reference numeral 1 and shown in FIG. 1, includes a boot 2 constituted by an external sole 3 adapted to be affixed to the upper plate 4 of a frame 5 on which the wheels 6 are arranged, soles from which an upper 7 extends, covering the entire foot and extending generally in the direction of the skater's ankle.

The sole 3 of the boot 2 is affixed to the horizontal upper plate 4 using binding means such as screws, riveting, adhesion, etc.

The frame also includes a lower portion extending perpendicularly to the plate 4, and constituted, for example, by two vertical lateral wings or walls 10 that are parallel to one another. The lateral wings 10 are respectively extended at their upper portions by a perpendicular return, each being directed inwardly and constituting a plane corresponding to the horizontal plate 4. In this manner, the vertical lateral wings 10, with the sole 3 of the boot 2, generally define an inverted "U" between the wings of which a plurality of wheels 6 are mounted, as many as four, for example, the wheels being mounted through central portions or hubs 11 with axles XX' affixed to the frame 5 to constitute a rolling train, the central hubs extending along a central axial housing of respective wheels, through respective pairs of bearings 21 arranged on opposite sides of the wheels.

According to the invention, and in a general manner, at least one of the wheels 6 includes means for height adjustment with respect to the frame 5 that are constituted by off-centered zones inserted between the ends or end portions 12 of the central hub of such wheel 6 and a fixed portion of the frame 5, so as to modify the rolling plane of the wheels 6 on the ground to the preference of the skater, depending on the type of skating involved. In the example shown in the figures, the adjustment means are provided on the two central wheels; they could also be provided on each of the end wheels.

According to the selected embodiment, the means for adjusting the height of the central wheels 6 are constituted by two end zones 12 of the central hub 11 that are integral thereto and off-centered with respect to the axis XX', and which capable of taking support, along a selected orientation, in corresponding fixed housings 13 provided in the inner wall of the frame 5.

Figure 4:
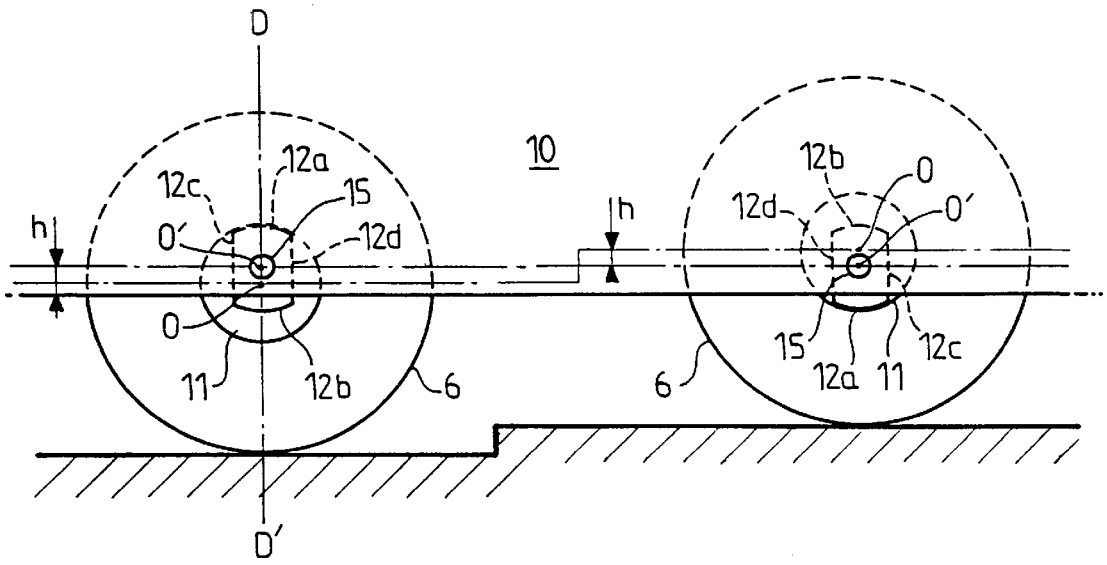
FIG. 4 in a schematic view showing a frame and a wheel in a rockering position and an anti-rockering position, respectively.
Figure 5:
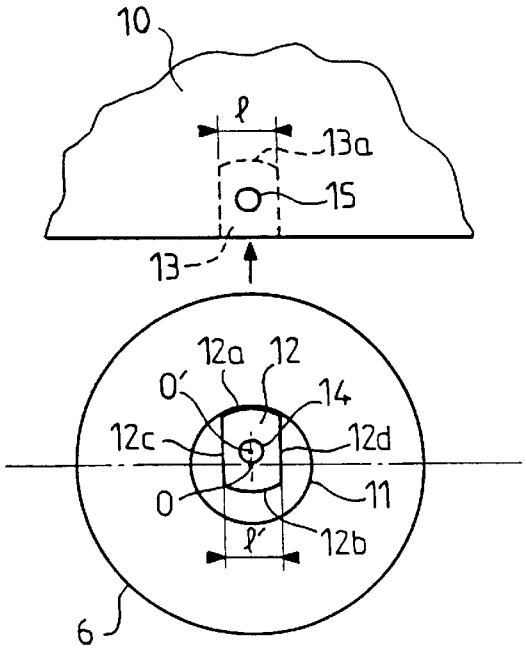
FIGS. 5 and 6 respectively show, according to FIG. 4, wheels being mounted on a frame in view of a rockering position and an anti-rockering position.
Figure 6:
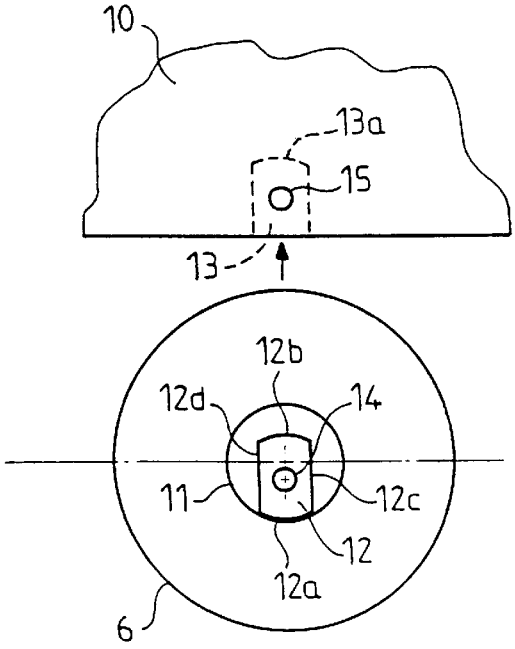

As shown more particularly in FIGS. 4–6, the eccentrics 12 forming the end zones of the hub 11 of each wheel 6 are constituted by two opposite lateral end surfaces 12*a*, 12*b*, arranged on a common diametral axis DD' of the wheel 6, and positioned with respect to the center O of the hub thereof, at different distances, such that depending on the direction in which the eccentrics 12 are mounted in the corresponding fixed housings 13 of the frame 5. As can be seen in FIGS. 4–6, the cross-sectional area of the end portions 12 is less than that of the central portion 11 and, in the particular illustrated embodiment, the cross-sectional area of the end portions is contained within the cross-sectional area of the central portion. Outer surface 12*a* of each end portion 12 is shown to be co-extensive with the outer surface of the central portion of the hub 11, whereas outer surface 12*b* of each end portion is inwardly spaced from the outer surface 11, the wheel 6 involved is, or is not, offset in height with respect to the frame 5.

In fact, the opposite end surfaces 12*a*, 12*b*, of each of the eccentrics fit in a circle whose radius is less than that of the cylindrical hub 11 of the wheel 6, and whose center O' is offset with respect to the center O of the hub according to the off-centering value "h" to be obtained.

The circle into which the end surfaces 12*a*, 12*b* of each eccentric 12 fit can also be provided to be the same as the circle into which the hub 11 fits.

According to the present invention, the rounded end surfaces 12*a*, 12*b* of each eccentric 12 are demarcated by two flat surfaces 12*c*, 12*d*, that are parallel and symmetrical with respect to the diametral axis DD' of the surfaces 12*a*, 12*b*.

According to another characteristic of the invention, each fixed housing 13 of the frame 5 adapted to the positioning of the eccentric 12 of the hubs of the wheels 6 is formed by a vertical groove whose width f is substantially equal to the width 9 of the eccentric between the two flat surfaces 12*c*, 12*d*, and open at its lower portion to enable the introduction of the eccentric. Each housing 13 forms, at its upper portion, an abutment 13 with a rounded profile that corresponds to that of the opposite end surfaces 12*a*, 12*b*, of the eccentrics.

Figure 2:
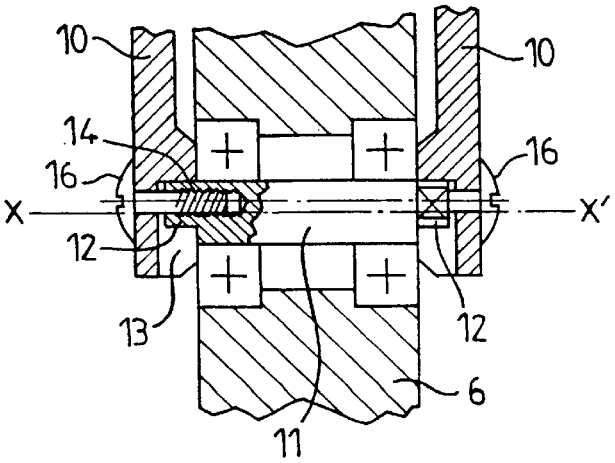
FIG. 2 is a partial transverse cross sectional view of a frame according to FIG. 1, the cross section of the wheel shown being performed for only one of its sides, at the level of the eccentric constituting the height adjustment device, according to a first embodiment.

As readily shown in. FIG. 2, the means for immobilizing each wheel 6 with respect to the frame 5 are constituted by threaded holes 14 provided at each front end of the off-centered portions 12 of the hub 11 of wheels 6 and adapted to be positioned across from corresponding fixed holes 15 provided on each lateral wing 10 of the frame 5 and opening inside of the groove 13, regardless of the selected position of the eccentric 12, therefore of the wheel 6, in order to allow for the passage of a binding screw 16.

Figure 3:
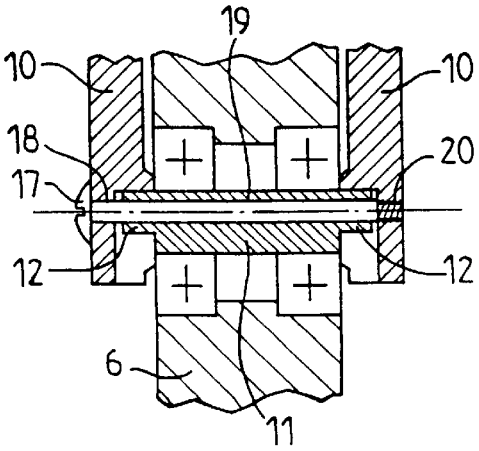
FIG. 3 is a partial transverse cross sectional view of a frame according to FIG. 1, according to a second embodiment of the height adjustment device.

According to an alternative embodiment shown in FIG. 3, the means for immobilizing each wheel 6 with respect to the frame 5 are constituted by a screw 17 which extends through a hole 18 provided in one of the lateral wings 10 of the frame 5, across from a cylindrical hole 19 extending right through the hub 11, such that the screw 17 crosses it freely, and is screwed in a threaded hole 20 of the other lateral wing 10 of the frame 5, regardless of the selected position of the eccentric.

According to another characteristic of the invention, the length of the hub 11 of the wheels 6, including the eccentric 12, is substantially shorter during the spacing of the internal surfaces of the grooves 13 for positioning the eccentrics 12, so as to provide during the tightening of the screws 16 or 17, a pressure on the internal ring of each of the ball bearings 21, carried by the hub 11, via an associated support surface 10*a* of the frame.

It will be noted that obtaining the eccentrics directly on the hub of each wheel makes it possible to avoid the drawbacks related to the use of additional elements (spacers), such as risk of loss, clearances, and to limit the handling that are necessary for adjusting the height of each wheel, as well as the risks of alignment errors.

Preferably, in a non-limiting manner, the hubs used will have a diameter on the order of at least 8 mm to enable a sufficient adjustment of the wheels.

The instant application is based on French Priority Patent Application No. 96.03564, filed on Mar. 18, 1996, the disclosure of which is hereby expressly incorporated by reference thereto, and the priority of which is hereby claimed under 35 U.S.C §119.

What is claimed:

1. An in-line roller skate comprising:

a frame having an upper plate and a lower portion, said lower portion having two substantially parallel lateral walls having symmetrically arranged fixed housings;

a boot having a sole fixed to said upper plate of said frame;

a plurality of wheels longitudinally arranged on said lower portion of said frame between said lateral walls;

at least one of said wheels comprising a height-adjusting arrangement to adjust the height of a wheel of said at least one of said wheels with respect to said frame, said wheel having a central axial housing extending along a central rotational axis of the wheel and a pair of bearings arranged symmetrically in said central axial housing on each of opposite sides of said wheel, aid height-adjusting arrangement comprising a central integrally formed axle extending through said pair of bearings, said axle comprising a cylindrical central portion having a central axis coaxial with the central rotational axis of said central housing and two opposite end portions integrally formed with said cylindrical portion and which are attached to said lateral walls along a second axis offset with respect to said central axis of said central portion, said central portion being adapted to support said pair of bearings, said end portions extending outwardly from said central portion to fit within said fixed housings of said frame in a selected rotational orientation to control a vertical position of said second axis with resect to said central rotational axis of said wheel.

2. An in-line roller skate according to claim 1, wherein:

a cross section of at last one of said two opposite end portions fits into a circle defined by a cross section of the central portion of the axle.

3. An in-line roller sate according to claim 1, wherein:

a cross section of at least one of said two opposite end portions fits into a circle having a radius less than a radius of a circle defined by a cross section of the central portion of the axle.

4. An in-line roller skate comprising:

a frame having an upper plate and a lower portion, said lower portion having two substantially parallel lateral walls having symmetrically arranged fixed housings;

a boot having a sole fixed to said upper plate of said frame;

a plurality of wheels longitudinally arranged on said lower portion of said frame between said lateral walls;

at least one of said wheels comprising a height-adjusting arrangement to adjust the height of a wheel of said at least one of said wheels with respect to said frame, said wheel having a central axial housing extending along a central rotational axis of the wheel and a pair of bearings arranged symmetrically in said central axial housing on each of opposite sides of said wheel, said height-adjusting arrangement comprising a central integrally formed hub extending through said bearings, said hub comprising a cylindrical central portion having a central axis coaxial with the central rotational axis of said central housing and two end portions integrally formed with said cylindrical portion and which are attached to said oral walls along a second axis offset with resect to said central axis of said central portion, said central portion being adapted to support said pair of bearings, said end portions extending outwardly from said central portion to fit within said fixed housings of said frame in a selected rotational orientation to control a vertical position of said second axis with respect to said central rotational axis of said wheel;

said cylindrical central portion and said end portions forming together a one-piece hub;

each of said fixed housings within which a respective one of said end portions of said hub having a cross-sectional area less than a cross-sectional area of said central portion of said hub.

5. An in-line roller skate according to claim 4, wherein:

said end potions of said hub have two opposite lateral surfaces arranged on a common diametrical axis of said wheel and axle positioned with respect to a center of said wheel, at different distances, such that said wheel is selectively offset in height with respect to other of said plurality of wheels depending upon a direction in which said end portions are mounted in respective ones of said fixed housings of said frame.

6. An in-line roller skate according to claim 5, wherein:

each said end portion comprises rounded end surfaces demarcated by two flat surfaces, said two flat sis being parallel and symmetrical with respect to said diametrical axis of said wheel.

7. An in-line roller skate according to claim 6, wherein:

each said fixed housing has a vertical groove adapted to fit said two flat surface of a respective one of said end portions, said vertical groove comprising an opening at a lower portion to enable introduction of said a respective said end portion and comprising an abutment of rounded profile at an upper portion that corresponds to a profile of opposite end surfaces of said end portions.

8. An in-line roller skate according to claim 4, wherein:

each of said end portions of said hub includes a threaded hole adapted to be positioned across from corresponding fixed holes provided on each of said lateral walls of said frame, regardless of a selected position of said end portions, and therefore of said wheel, to enable passage of a binding screw provided to secure said wheel to said frame.

9. An in-line roller skate according to claim 4, further comprising:

a screw extending through a first hole provided in one of said lateral walls of said frame;

a second hole, opposite said first hole, extending evenly through said hub, whereby said screw extends freely through said second hole;

a third hole provided in a second of said lateral walls of said frame and threaded to receive said screw.

10. An in-line roller skate according to claim 4, wherein:

each of said lateral walls of said frame has a bottom surface and said hub, including said end portions, is substantially shorter than a distance between bottom surfaces of said fixed housings of said lateral walls of said frame.

11. An in-line roller skate comprising:

a frame having an upper plate and a lower portion, said lower portion having two substantially parallel lateral walls having symmetrically arranged fixed housings;

a boot having a sole fixed to said upper plate of said frame;

a plurality of wheels longitudinally arranged on said lower portion of said frame between said lateral walls;

at least one of said wheels comprising a height-adjusting arrangement to adjust the height of a wheel of said at least one of said wheels with respect to said frame, said wheel having a central axial housing extending along a central rotational axis of the wheel and a pair of bearings arranged symmetrically in said central axial housing on each of opposite sides of said wheel, said height-adjusting arrangement comprising a central integrally formed hub extending through said pair of bearings, said axle comprising a cylindrical central portion having a central axis coaxial with the central rotational axis of said central housing and two end portions integrally formed with said cylindrical portion and which are attached to said lateral walls along a second axis offset with respect to said central axis of said central portion, said central portion being adapted to support said pair of bearings, said end portions extending outwardly from said central portion to fit within said fixed housings of said frame in a selected rotational orientation to control a vertical position of said second axis with respect to said central rotational axis of said wheel;

said cylindrical central portion and said end portions forming together a one-piece hub;

a transverse cross section of each of said end portions having an area less than a transverse cross section of said central portion.

12. An in-line roller skate according to claim 11, wherein:

each of said end portions has one arcuate outer surface co-extensive with an outer surface of said central portion of said hub, and another arcuate outer surface inwardly spaced from said outer surface of said central portion.

* * * * *